US005889517A

United States Patent [19]

Ueda et al.

[11] Patent Number: 5,889,517

[45] Date of Patent: Mar. 30, 1999

[54] MULTI-WINDOW DISPLAY CONTROL SYSTEM

[75] Inventors: Masashi Ueda; Ryohei Komiya, both of Nagoya, Japan

[73] Assignee: Brother Kogyo Kabushiki Kaisha, Nagoya, Japan

[21] Appl. No.: 719,079

[22] Filed: Sep. 24, 1996

[30] Foreign Application Priority Data

Oct. 26, 1995 [JP] Japan ..... 7-279367

[51] Int. Cl.[6] ..... G09G 1/16

[52] U.S. Cl. ..... 345/339; 345/340; 345/343

[58] Field of Search ..... 345/1, 3, 30, 98, 345/100, 112, 115, 118, 119, 120, 127, 132, 340, 341, 342, 343, 344, 348; 395/118, 339, 340, 342, 343, 344, 501, 507, 509

[56] References Cited

U.S. PATENT DOCUMENTS 4,599,612 7/1986 Kaji et al. ..... 345/115
4,710,762 12/1987 Yamada ..... 345/115
4,725,830 2/1988 Kawai et al. ..... 345/340
4,829,294 5/1989 Iwami et al. ..... 345/340
4,920,337 4/1990 Kuo ..... 345/115
4,975,690 12/1990 Torres ..... 345/340
5,305,435 4/1994 Bronson ..... 345/351
5,621,430 4/1997 Bricklin ..... 345/340

*Primary Examiner*—Mark K. Zimmerman
*Assistant Examiner*—Vincent E. Kovalick
*Attorney, Agent, or Firm*—Oliff & Berridge, PLC

[57] ABSTRACT

A multi-window display control system includes a display area setting device for setting a first display area in the display area on a physical screen and setting a second display area in another area, different than the first display area. A display controller controls display of an active window or windows selected as application software and all the other inactive windows in the second display area so as not to overlap each other.

31 Claims, 5 Drawing Sheets

MULTI-WINDOW DISPLAY CONTROL SYSTEM

BACKGROUND OF THE INVENTION

1. Field of the Invention

The present invention relates to a multi-window display control system and, more particularly, to a multi-window control system for displaying a plurality of independent logical windows on a physical screen of, for example, a CRT (cathode ray tube) and a LCD (liquid crystal display).

2. Description of Related Art

Recently, a system capable of displaying a plurality of independent windows simultaneously on a CRT screen connected to a personal computer, a work station, or the like, has become popular. Such a system is called a multi-window system. The use of such a system permits the user to operate different application software at the same time and hence permits the user to edit information displayed on one window while seeing information displayed on another window. Thus, the user's efficiency in performing operations has been improved to a remarkable extent.

In the multi-window control system, however, there sometimes occurs a case where too many windows are displayed on the CRT screen. For example, when plural windows are to be displayed in the multi-window system, a newly selected window is put on a window that has already been selected, with the result that plural windows are displayed on the CRT screen in a stacked state. This state is closely similar to a scattered state of many documents on a desk. In this state, the user has difficulty in seeing each window, so that the operability and the working efficiency are deteriorated.

SUMMARY OF THE INVENTION

In view of the above-mentioned problems, according to at least one aspect of the present invention, there is provided a multi-window control system including a display area setting device for setting a first display area in the display area of a physical screen and setting a second display area in an area other than the first display area on the screen, and a display control device for displaying active windows selected as objects of work in the first display area and displaying all the other inactive windows in the second display area so as not to overlap each other.

Preferably, in the above multi-window control system, the display area setting device changes the ratio between the first and second display areas in accordance with the number of such active windows and that of such inactive windows as mentioned above.

Preferably, in any multi-window control system above, the display control device is constructed so as to arrange the inactive windows in the second display area in accordance with a time sequence selected as an object of work.

Further, in any multi-window control system described above, the display control device includes a calculating device for calculating the area per window of the inactive windows on the basis of both the number of the inactive windows and the area of the second display area. The display control device also includes an area changing device for changing the area of the inactive windows so as to become coincident with the area per window calculated by the calculating device.

Still further, in any multi-window control system described, a window changing device is provided for changing the active windows into inactive windows when the number of the active windows exceeds the number of active windows capable of being displayed in the first display area.

Preferably, in any multi-window control system described, the display control device is constructed so as to display the active windows in a larger size than the inactive windows.

It should be readily clear from the above that according to the multi-window control system of the present invention the display area on a physical screen such as a CRT is divided into first and second display areas, with windows (active windows) or the like as objects of work performed by the user being displayed in the first display area. Therefore, the windows being noted by the user are displayed in a conspicuous manner, thus leading to improvement of the operability and working efficiency. Also, since the other windows are displayed in the second display area so as not to overlap each other, the user can easily recognize the presence of windows even those to which the user is not paying attention. Further, if the windows in the second display area are arranged in accordance with a certain rule or protocol, then even in the case of selecting any of the unnoticed (inactive) windows as new application software, it becomes easier to specify the new selection.

BRIEF DESCRIPTION OF THE DRAWINGS

Preferred embodiments of the present invention will be described in detail with reference to the following figures, wherein.

DETAILED DESCRIPTION OF PREFERRED EMBODIMENTS

Reference will first be made below to basic conceptions underlying the present invention.

The number of windows capable of being attended to simultaneously by a human is only several windows at most. When many windows are displayed at one time, the user cannot pay attention to all of them simultaneously. Further, additional windows being displayed but not used detract the user's attention from the windows that are being primarily used. Therefore, rather than overlapping many windows and providing a complicated display, it is preferred from the standpoint of operability that only one or two windows that the user truly wants to see be displayed in a large and conspicuous manner and that the other windows be displayed each in a size not obstructing the large window or windows. Additionally, in the case of searching for one window from among plural windows, it is easier for the user to select the one window if the plural windows each have identification information or are arranged in accordance with some rule or protocol.

Figure 1:
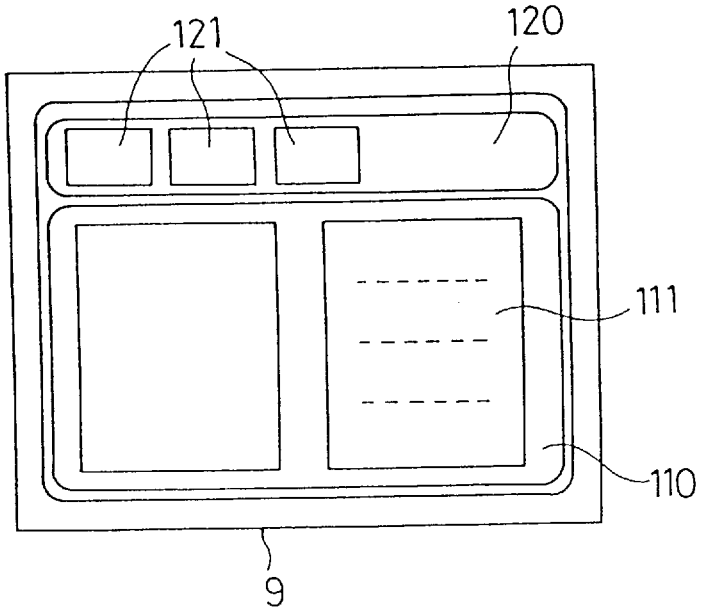
FIG. 1 is a plan view showing an example of a display made by a multi-window control system embodying the present invention.
Figure 1A:
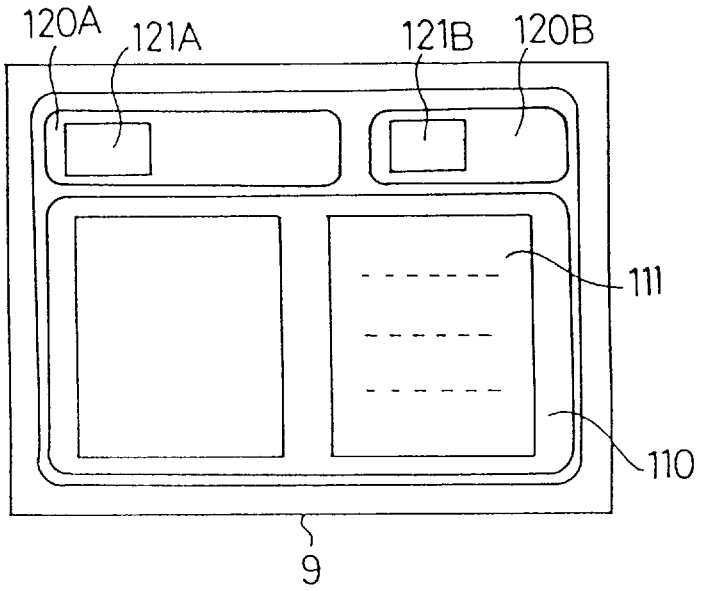
FIG. 1A is a plan view showing another example of a display made by a multi-window control system embodying the present invention.

In the present invention, in view of the above observations and as illustrated in FIG. 1, the display area on a CRT 9 is divided into a first display area 110, also referred to as an active display area, and a second display area 120, also referred to as an inactive display area. In the first display area 110 are displayed windows that the user truly wants to see, for example in a larger size. In the second display area 120 are displayed the other windows each in a relatively small size so as not to overlap each other, these windows each being given identification information or being arranged in accordance with a certain rule. FIG. 1A shows another sample display area on a CRT 9 divided into a first display area 110 and a plurality of second display areas 120A and 120B. Each second display area 120A, 120B can display patterns or windows relating to operations that are not being actively used at the present time. Any number of second or inactive display areas can be used depending on the particular user's requirements. Further, the arrangement of patterns or windows in each second display area can be grouped based on similar functions or some other standard protocol, such as an order of use. Although in the following embodiments the CRT 9 is mentioned as a display unit, it may be substituted by another known display unit, such as an LCD.

Next, preferred modes of the embodiments of the present invention will be described below with reference to the drawings.

Figure 2:
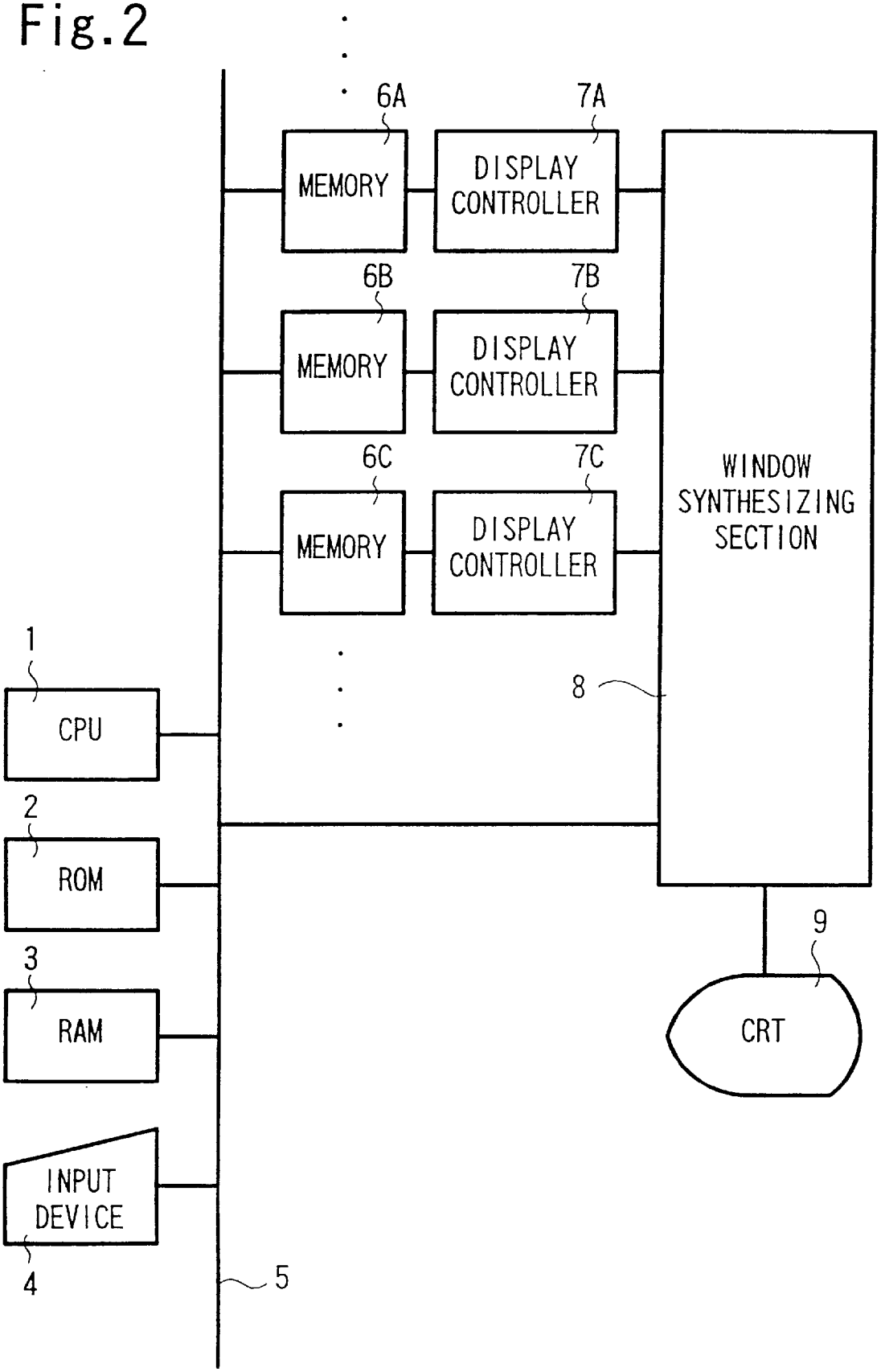
FIG. 2 is a block diagram showing the configuration of the multi-window control system.

FIG. 2 is a block diagram showing the configuration of a multi-window control system embodying the present invention. As illustrated therein, the multi-window control system has a CPU (central processing unit) 1, a ROM (read-only memory) 2, a RAM (random access memory) 3, an input device 4 such as a keyboard and a mouse, a bus 5, a plurality of memories 6 (6*a*, 6*b*, . . . ), display controllers 7 (7*a*, 7*b*, . . . ) corresponding to the memories 6, a window synthesizing section 8, and a CRT 9.

The ROM 2 stores various processing programs. The CPU 1 reads and executes those programs and thereby makes a display control. The details of this control will be described later. Directions and information necessary for work are inputted from the input device 4 by the user. To the bus 5 are connected the CPU 1, ROM 2, RAM 3, input device 4, and memory 6, to give and receive information among the components.

The RAM 3 stores information etc. set arbitrarily by the user such as the ratio and positional relation between the first and second display areas 110, 120 in the CRT 9. Also stored therein is information for determining a window sequence arrangement when the windows in the second display area 120 are to be arranged in accordance with the user's desire.

User directions are inputted from the input device 4, including such necessary information such as a direction to the effect of starting up a specific application software, a direction to the effect of displaying a specific window in the first display area 110, and a direction to the effect of transferring a window from the first display area 110 into the second display area 120. In the following description, a window corresponding to application software selected for operation by the user will be designated an "active window" and any other window designated an "inactive window." An active window 111 is displayed large in the first display area 110, while an inactive window 121 is displayed small in the second display area 120.

The memories 6 store image data of individual windows displayed on the CRT 9. The volume of the image data stored in the memories 6 is allocated on the assumption that the whole of the CRT 9 is the first display area 110. It is necessary that the image data volume be not less than the data volume required when only one window is displayed in the whole of the first display area 110. In the case where such window is to be displayed as an inactive window 121 in the second display area 120, image data are also stored in the memories 6, such as the title of a window to be displayed in place of the window and a symbol set arbitrarily by the user. For the convenience of explanation, in FIG. 2 there are provided a plurality of memories 6*a*, 6*b*, . . . corresponding to windows, but actually the storage locations of a single memory may be allocated to each window.

The display controllers 7 control how to display on the CRT 9 the image data etc. stored in the memories 6. This display method control involves display pattern control and display position control. The display pattern controller controls in what mode each window is to be displayed particularly in the second display area 120. For example, the control is made so as to display each window in the second display area in a compressed state as compared with the display in the first display area 110, or the control is made so as to substitute the compressed window by the display of its title (e.g. the name of an application software) or a symbol set arbitrarily by the user correspondingly to the application software.

More specifically, when only one window is to be displayed in the first display area 110, the image data stored in the memories 6 are fed to the window synthesizing section 8 so as to be displayed as they are without any change in their scale. When two windows are to be displayed side by side in the first display area 110, the image data stored in the memories 6 are compressed to one-half and the thus-compressed data are fed to the window synthesizing section 8. Further, when the windows are to be displayed in the second display area 120, the image data stored in the memories 6 are compressed in a predetermined ratio, for example on a scale of 1/8 or 1/16, to prepare display patterns, which are then fed to the window synthesizing section 8. Display patterns, in place of such compressed windows, application software titles, symbols set by the user, or icons, may be displayed in the second display area 120. In this case, the image data corresponding to those titles, symbols, or icons, are read from the memories 6 and fed to the window synthesizing section 8. The compression of image data can be effected by a known method, for example by thinning-out of data. On the other hand, the display position controller determines in which position in the first display area 110 or the second display area 120 each window is to be displayed on the CRT 9.

The window synthesizing section 8 displays on the CRT 9 the image data fed from the display control section 7. More specifically, an instruction is made to display the active window 111 selected and designated by the user in the first display area 110 and the inactive window 121 in the second display area 120. The window synthesizing section 8 also has the function of changing the ratio between the first and second display areas 110, 120 in the displayable area of the CRT 9. The details of the ratio changing method will be described later.

An example of display control operations will be described below with reference to the flowchart of FIG. 3. For performing the following operations the CPU 1 executes the programs prestored in the ROM 2. It is here assumed that the ratio in area on the CRT 9 between the first and second display areas 110, 120, as well as their positions, are set in advance by the user.

First, a check is made to see if the user has selected an application software (step S1). The window corresponding to the selected application software is displayed as an active window 111 in the first display area 110. Once the application software has been selected (YES in step S1), a check is made by the window synthesizing section 8 to see if there is any vacant area in the first display area 110 (step S11). If there is a vacant area, or if the first display area is not full (NO in step S11), the display controllers 7 output image data in an amount required for display in the first display area 110, and the window synthesizing section 8 displays the image data as an active window 111 in the first display area 110 as shown in FIG. 1 (step S27).

On the other hand, if it is determined in step S11 that there is no vacant area in the first display area 11, or the first display area is full (YES in step S11), a question is raised to the user whether one of the active windows 111 in the first display area 110 is to be closed or not (step S13). If the user does not want to close any active windows 111 (NO in step S13), the CPU 1 provides on the CRT 9 an indication to the effect that the application software concerned cannot be selected (step S15). On the other hand, if in step S13 the user selected one active window 111 to be closed (YES in step S13), the CPU 1 closes that active window 111 and performs a transfer work to the second display area 120. In more particular terms, the CPU 1 determines a display pattern and a display position of that window in the second display area 120 and displays them in the second display area 120 (steps S17 to S23).

This point will now be described more specifically. First, the CPU 1 closes the selected active window 111 (step S17). Then, the display controllers 7 read from the memories 6 the image data corresponding to the closed window and compress the image data in a predetermined ratio for display in the second display area 120 to prepare a display pattern, then input the display pattern to the window synthesizing section 8 (S19). Further, the display controllers 7 determine a display position of the display pattern (S21). The display position follows a time sequence that has already been selected as an application software and displayed in the first display area 110. For example, a display is made successively in order from old to new starting with the left-hand side on the screen of the CRT 9. The window synthesizing section 8 displays the display pattern prepared in step S19 as an inactive window 121, in the predetermined position in the second display area 120 that was determined in step S21 (step S23).

Further, the application software selected in step S1 is newly displayed as an active window 121 in the vacant area included in the first display area 110 that was formed by closing one active window 111 in step S17 (step S25).

Although in step S19 a display pattern is prepared by compressing image data corresponding to the closed window of application software, for example the title of the application software, a symbol set by the user, or an icon, may be used as the display pattern, as noted previously. In this case, the image data corresponding to the title, symbol or icon are read from the memories 6 and fed to the window synthesizing section 8. The selected title, symbol or icon to be used as the display pattern can be set beforehand by the user with use of the input device 4.

On the other hand, if the user did not choose a new application software in step S1 (NO in step S1), a question is raised as to whether an active window 111 now on display in the first display area 110 is to be closed or not (step S3). If the user does not want to close the active window 111 (NO in step S3), the processing is ended. While if the user instructed to close the active window 111 (YES in step S3), the active window is transferred into the second display area 120 (steps S5 to S9) through the same operations as in the foregoing steps S19 to S23. Steps S5, S7 and S9 correspond to steps S19, S21 and S23, respectively.

Although an example of a display control operation has been described above, it is possible to make the following various controls in the control system of the present invention.

Figure 4:
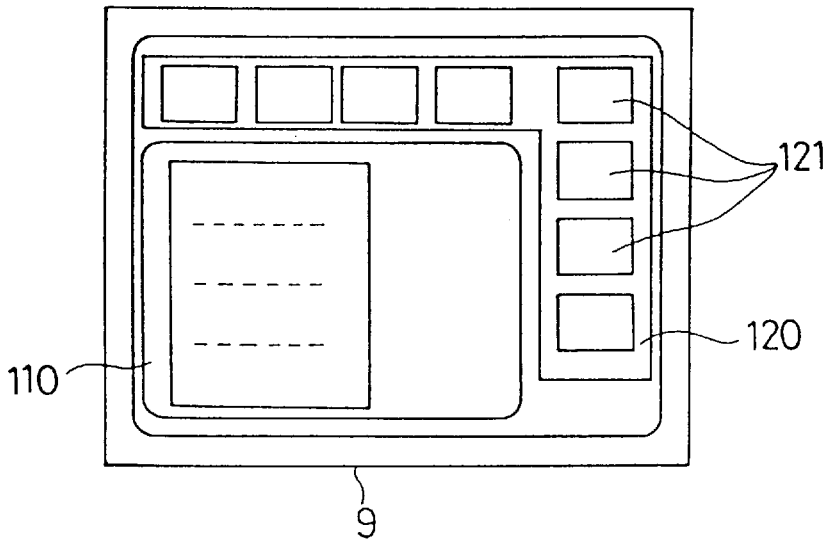
FIG. 4 is a plan view showing another example of display made by the multi-window control system.

First, although in the above embodiment the ratio in area between the first display area 110 and the second display area 120 in the displayable area of the CRT 9 is set beforehand by the user, the ratio may be rendered variable according to the number of windows displayed in each display area. For example, as shown in FIGS. 1 and 4, when the number of active windows 111 in the first display area 110 decreases and that of inactive windows 121 to be displayed in the second display area 120 increases, the first display area 110 may be contracted and the second display area 120 enlarged.

Although in the above embodiment the order selected in the past is used for the arrangement (order of display) of the inactive windows 121 in the second display area 120, the inactive windows may be arranged in accordance with an arbitrary order preset by the user, or the position may be determined for each type of application software.

Figure 5:
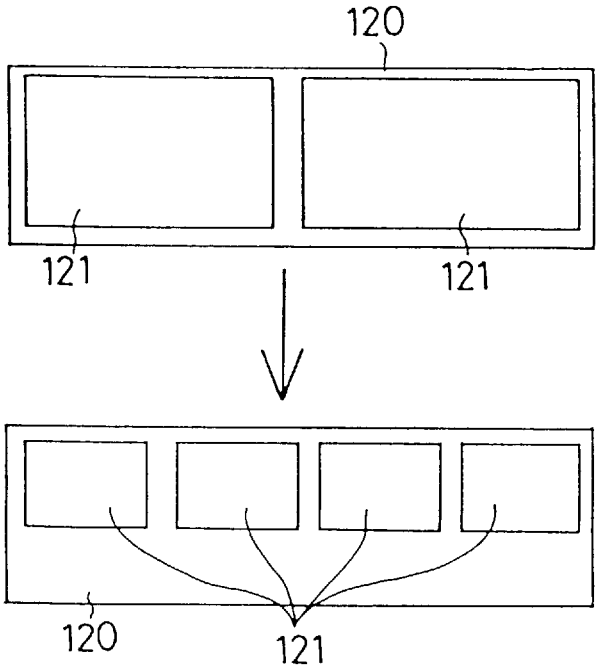
FIG. 5 is a plan view showing a modification of display made by the multi-window control system.

In the case where the area of the second display area 120 is fixed and the number of inactive windows 121 capable of being displayed in that area is limited, but nevertheless the number of inactive windows 121 to be displayed in the second display area 120 is larger than the limited number, an instruction may be made as in FIG. 5 wherein the size of each inactive window 121 is reduced so as to permit all the inactive windows 121 to be displayed in the second display area 120. This can be realized by changing the size of each inactive window 121 through the display controllers 7 in accordance with instructions given by the CPU 1.

Figure 3:
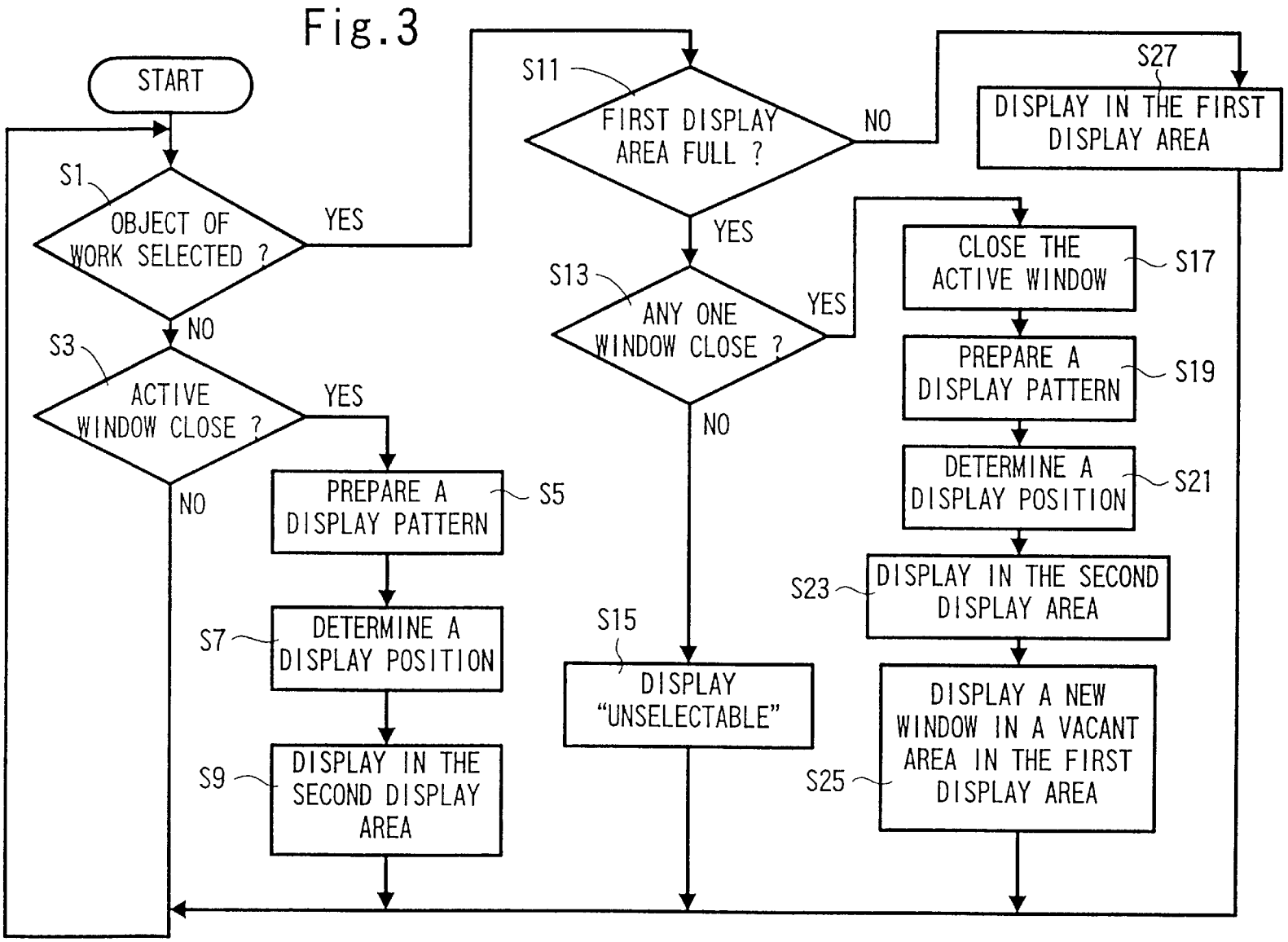
FIG. 3 is a flowchart showing an example of display operation performed by the multi-window control system.
Figure 6:
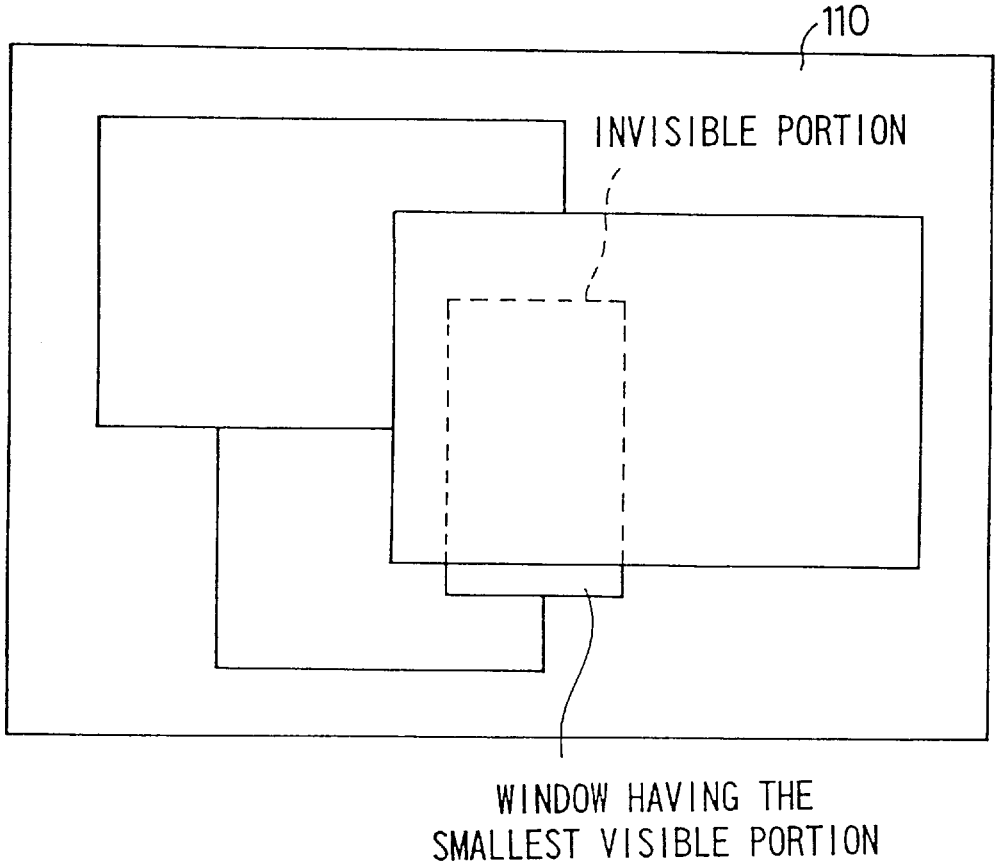
FIG. 6 is a diagram explaining the modification of display in the multi-window control system.

In the above embodiment, moreover, when it is determined in step S11 in FIG. 3 that there is no vacant area in the first display area 110, a question is raised to the user in step S13 as to whether any active window 111 is to be closed or not. A configuration may be adopted wherein one active window 111 is closed forcibly without asking the user, and then the newly chosen application software is displayed as an active window 111 in the first display area 110. In this case, to determine the order of selection of the active window 111 to be closed forcibly, an order may be adopted wherein the selection is made successively from old to new, or the order of importance of various works preset by the user. There also may be adopted a method wherein active windows are closed successively from long to short in terms of the time elapsed after their display on the first display area 110 or in terms of the time elapsed after the last work conducted by the user. Further, in the case where plural windows are set for overlapped display in the first display area 110, the window having the smallest visible portion may be closed first as in FIG. 6.

While advantageous embodiments have been chosen to illustrate the invention, it will be understood by those skilled in the art that various changes and modifications can be made therein without departing from the scope of the invention as defined in the appended claims.

What is claimed is:

1. A display control system, comprising:

an input that allows a user to select operations and to input display instructions regarding selected operations;

a memory coupled to the input that stores input selections and instructions; and a display controller coupled to the memory and the input that controls display of selected operations by configuring the display into distinct areas of operations, including a first area of active operations and a second area of inactive operations, wherein each area of operations is capable of displaying multiple work windows.

2. The display control system of claim 1, wherein the display controller controls the display of selected operations based on patterns that are representative of each particular operation.

3. The display control system of claim 2, wherein the display controller controls the size of each pattern within each area of operations based on a total size of each area of operations and a number of patterns to be displayed in each area of operations.

4. The display control system of claim 2, wherein the display controller controls a location of each pattern within each area of operations based on a predetermined location protocol.

5. The display control system of claim 2, wherein the display controller controls placement of each pattern within each area of operations, wherein the display controller controls a plurality of patterns to be displayed in a non-overlapping manner.

6. The display control system of claim 1, wherein the display controller controls relative size of each area of operation.

7. The display control system of claim 1, wherein the display controller transfers display of operations between the active operation area and the inactive operation area.

8. The display control system of claim 1, wherein the display controller transfers display of operations between the active operation area and the inactive operation area based on input instructions.

9. The display control system of claim 1 wherein the operations relate to individual software programs and the controller controls access to the software programs depending upon in which operation area a particular operation is controlled to be displayed.

10. The display control system of claim 1, further comprising, in combination with the display control system, a display device that simultaneously displays plural areas, each having multiple work windows displayed therein, including an active area in which work windows can be accessed for use and an inactive area in which work windows cannot be accessed for use.

11. The display control system of claim 1, wherein the display controller controls placement of the first area of active operations and the second area of inactive operations to be non-overlapping.

12. The display control system of claim 1, wherein the display controller configures the display into a plurality of second areas of inactive operations.

13. The display control system of claim 1, wherein at least one work window within the second area of inactive operations is displayed in a compressed state.

14. The display control system of claim 1, wherein at least one of an application software designation, a symbol set by the user and an icon are displayed within at least one work window within the second area of inactive operations.

15. A multi-window display control system including:

display area setting means for setting a first display area capable of displaying multiple work windows on a screen and setting a second display area capable of displaying multiple work windows on the same screen; and display control means for controlling display of at least one active work window selected by a user in the first display area and displaying at least one inactive work window in the second display area, wherein the active work window and inactive work window are arranged to be non-overlapping.

16. The multi-window display control system of claim 15, wherein the display control means controls display of a plurality of windows in at least one of the first display area and the second display area, the plurality of windows being arranged in a non-overlapping manner.

17. The multi-window display control system of claim 15, wherein the display setting means sets a plurality of second display areas each displaying at least one inactive window.

18. The multi-window display control system of claim 13, wherein the display area setting means changes a size ratio between the first display area and the second display area based on how many active windows and inactive windows are being simultaneously displayed.

19. The multi-window display control system of claim 15, wherein the display control means arranges the inactive windows in the second display area in accordance with a time sequence of previously selected windows.

20. The multi-window display control system of claim 15, wherein the display control means includes:

determining means for determining an area of each window of the inactive windows to be displayed in the second display area based on a number of inactive windows and a total area of the second display area; and area changing means for changing an area of each inactive window corresponding to the determined area of each window.

21. The multi-window display control system of claim 15, further including window changing means for changing a status of an active window to an inactive window when all of the active window cannot be displayed in the first display area because of size constraints.

22. The multi-window display control system of claim 15, wherein the display control means controls display of the at least one active window to be larger than display of the at least one inactive window.

23. The multi-window display control system of claim 15, wherein at least one inactive window within the second display area is displayed in a compressed state.

24. The multi-window display control system of claim 15, wherein at least one of an application software designation, a symbol set by the user and an icon are displayed within at least one inactive window within the second display area.

25. A method of controlling the display of a plurality of operation windows, comprising the steps of:

dividing a display area into an active display area for operation windows actively used and an inactive display area for operation windows not actively used;

establishing a size of each operation window in each display area;

establishing a position for each operation window in each display area; and selecting at least one operation window to be displayed in the active display area.

26. The method of claim 25, further comprising the steps of determining if the selected operation window can fit in the active display area, wherein when the selected window can fit, then positioning the selected operation window in the active display area, and wherein when the selected window cannot fit, then selecting a previously displayed active window to be moved to the inactive display area to allow the selected operation window to be positioned in the active display area.

27. The method of claim 25, wherein the step of establishing a size of each operation window in each display area includes determining how many windows are to be displayed compared to a total size of the display area.

28. The method of claim 25, wherein the step of establishing a position for each operation window in each display area includes positioning the operation windows based on a preset protocol corresponding at least one factor selected from the following group of factors: frequency of use of a window, length of time a window has been displayed, and amount of window that is displayed when overlapped with other windows.

29. The method of claim 25, further comprising the step of warning a user when an operation window cannot be displayed as instructed.

30. The method of claim 25, wherein the step of establishing a position for each operation window in each display area includes arranging the operation windows in a non-overlapping manner.

31. The method of claim 25, wherein the step of dividing a display area includes dividing the display area into the active display area and a plurality of inactive display areas.

* * * * *